US010694795B2

(12) United States Patent
Ragan

(10) Patent No.: US 10,694,795 B2
(45) Date of Patent: Jun. 30, 2020

(54) GLOVE CONSTRUCTION

(71) Applicant: SHELBY GROUP INTERNATIONAL, INC., Collierville, TN (US)

(72) Inventor: Thomas G. Ragan, Collierville, TN (US)

(73) Assignee: Shelby Group International, Inc., Collierville, TN (US)

( * ) Notice: Subject to any disclaimer, the term of this patent is extended or adjusted under 35 U.S.C. 154(b) by 403 days.

(21) Appl. No.: 15/403,061

(22) Filed: Jan. 10, 2017

(65) Prior Publication Data

US 2018/0192716 A1 Jul. 12, 2018

(51) Int. Cl.
*A41D 19/00* (2006.01)
*A41D 19/015* (2006.01)

(52) U.S. Cl.
CPC ... *A41D 19/01547* (2013.01); *A41D 19/0044* (2013.01); *A41D 2400/44* (2013.01)

(58) Field of Classification Search
CPC ..... A41D 19/01547; A41D 19/0044; A41D 19/04; A41D 2400/44; A44C 5/208; A44C 7/00
USPC ..... 2/160, 161.7
See application file for complete search history.

(56) References Cited

U.S. PATENT DOCUMENTS 211,614 A 1/1879 Allebton
1,252,900 A 1/1918 Gkootell
2,004,382 A 6/1935 Palicki
2,072,541 A 3/1937 Burnham
2,082,467 A * 6/1937 Prins ..... B03B 5/02 209/156
2,194,934 A 3/1940 Whitcomb Geissmann
2,342,187 A 2/1944 Gardner
2,446,921 A 8/1948 Grant
2,561,891 A 7/1951 Tucker
2,578,188 A 12/1951 Ionides et al.
(Continued)

FOREIGN PATENT DOCUMENTS

DE 3922598 A1 1/1991
FR 2215179 A1 8/1974
(Continued)

OTHER PUBLICATIONS

Non-Final Office Action dated May 19, 2014, from U.S. Appl. No. 13/599,887. (17 pages).
(Continued)

*Primary Examiner* — Timothy K Trieu
(74) *Attorney, Agent, or Firm* — Neal, Gerber & Eisenberg LLP; Thomas E. Williams

(57) ABSTRACT

A glove is disclosed having a donning assister to enable a wearer of the glove to quickly and easily don a glove on a wearer's hand. In one embodiment, the glove includes a wrist cuff portion, a hem portion positioned at a base of the wrist cuff portion, an at least partially enclosed space formed within the hem portion, and a gripper positioned in the at least partially enclosed space. The at least partially enclosed space is defined by hem stitches and by a pair of laterally opposed stitches positioned on the palm side of the glove anywhere along a circumference of the hem portion between a thumb of the glove on one end and a pinky finger of the glove on the other end.

19 Claims, 6 Drawing Sheets

(56) References Cited

U.S. PATENT DOCUMENTS 3,014,980 A 12/1961 Marshall
3,098,237 A 7/1963 Slimovitz
3,114,915 A 12/1963 Gross
3,625,790 A 12/1971 Ayres
3,869,726 A 3/1975 Bell et al.
3,879,764 A 4/1975 Weber-Liel et al.
4,194,041 A 3/1980 Allen, Jr. et al.
4,197,592 A 4/1980 Klein
4,209,857 A 7/1980 Clark et al.
4,355,424 A 10/1982 McCoy
4,370,365 A 1/1983 Takamizawa et al.
4,430,759 A 2/1984 Jackrel
4,433,439 A 2/1984 Sidman et al.
4,454,611 A 6/1984 Tschirch et al.
4,520,056 A 5/1985 Jackrel
4,545,841 A 10/1985 Jackrel
4,548,541 A 10/1985 Corompt
4,559,646 A 12/1985 Ertl
4,583,248 A 4/1986 Edwards
4,644,945 A * 2/1987 Thorner ..... A41B 9/023 2/403
4,679,257 A 7/1987 Town
4,733,413 A 3/1988 Dykstra
4,847,918 A 7/1989 Sturm
4,868,927 A * 9/1989 Bourdeau ..... A41F 1/06 2/161.1
4,918,756 A 4/1990 Grilliot et al.
4,991,593 A * 2/1991 LeVahn ..... A01N 1/02 128/853
5,020,161 A 6/1991 Lewis et al.
5,020,162 A 6/1991 Kersten et al.
5,063,919 A * 11/1991 Silverberg ..... A61F 13/041 2/16
5,088,124 A 2/1992 Dutchik et al.
5,123,119 A 6/1992 Dube
5,153,055 A 10/1992 Ko
5,349,705 A 9/1994 Ragan
5,361,415 A 11/1994 Deering
5,481,683 A 1/1996 Karim
5,560,044 A 10/1996 Masley et al.
5,566,405 A 10/1996 Masley et al.
5,569,507 A 10/1996 Goodwin et al.
5,598,582 A 2/1997 Andrews
5,603,119 A 2/1997 Rinehart
5,640,718 A 6/1997 Aldridge et al.
5,690,478 A 11/1997 Zoellner
5,700,544 A 12/1997 Goodwin et al.
5,732,413 A 3/1998 Williams et al.
5,740,551 A 4/1998 Walker
5,766,400 A 6/1998 Gallagher, Jr.
5,819,316 A 10/1998 Aldridge
5,822,791 A * 10/1998 Baris ..... A41D 19/0065 2/2.5
5,822,795 A 10/1998 Gold
5,822,796 A 10/1998 Harges et al.
5,851,683 A 12/1998 Plamthottam et al.
5,935,882 A 8/1999 Fujita et al.
5,960,478 A 10/1999 Sivret et al.
5,981,019 A 11/1999 Goodwin et al.
6,021,523 A 2/2000 Vero
6,048,810 A 4/2000 Baychar
6,061,833 A * 5/2000 Smith ..... A41D 19/01511 2/159
6,154,886 A 12/2000 Hottner
6,155,084 A 12/2000 Andrews et al.
6,243,875 B1 6/2001 French
6,591,427 B1 7/2003 Bennett
6,637,035 B1 10/2003 Brinkmann
6,718,556 B2 4/2004 Zuckerwar et al.
6,792,625 B2 9/2004 Hexels
6,871,359 B2 3/2005 Han
7,125,816 B1 10/2006 Baychar-Carrhassett
7,225,473 B2 6/2007 Schierenbeck et al.
7,480,944 B2 * 1/2009 Nascimento ..... A41F 1/06 2/159
7,644,448 B2 1/2010 Grilliot et al.
7,784,113 B2 8/2010 Ragan et al.
8,060,949 B2 11/2011 Carcaterra et al.
9,066,545 B2 6/2015 Klug et al.
9,072,325 B2 7/2015 Ragan
9,079,050 B2 7/2015 Bedetti et al.
9,510,628 B2 12/2016 Ragan
1,013,668 A1 11/2018 Ragan
1,020,119 A1 2/2019 Ragan
2002/0073474 A1 6/2002 Geng
2003/0015275 A1 1/2003 Phillips et al.
2003/0106133 A1 6/2003 Novak
2004/0098786 A1 5/2004 Hottner et al.
2006/0117457 A1 6/2006 Williams et al.
2007/0124849 A1 6/2007 Williams et al.
2010/0275341 A1 11/2010 Sweeney et al.
2011/0131707 A1 * 6/2011 Sauer ..... A61F 2/78 2/270
2013/0247278 A1 9/2013 Baehr et al.
2015/0121598 A1 5/2015 Mathews et al.
2016/0128400 A1 * 5/2016 Cookus ..... A41D 19/001 2/158
2018/0192716 A1 7/2018 Ragan
2019/0090560 A1 3/2019 Ragan
2019/0166931 A1 6/2019 Ragan

FOREIGN PATENT DOCUMENTS

JP 2004051723 A 2/2004
JP 5153938 B2 2/2013

OTHER PUBLICATIONS

Shelby Fire and Rescue Gloves, Barrier Attachment Methods [online], [retrieved on Jun. 26, 2012]. Retrieved from the Internet <URL: http://www.shelbyglove.com/shelby-FDP/index.html>, p. 8.

* cited by examiner

GLOVE CONSTRUCTION

BACKGROUND

This application relates generally to the field of hand protection systems, and more particularly to gloves for protecting a person's hand(s) from exposure to adverse environments.

As part of their job, firefighters may be exposed to extreme heat and hazardous environments when responding to a fire. The clothing firefighters wear must therefore be designed to protect against these extremes. The specialized gloves worn by firefighters may exhibit a number of characteristics to ensure that they adequately perform in such environments during use. Such gloves may include a plurality of layers joined together where each layer is constructed to provide a particular performance characteristic group of characteristics, such as breathability, durability, heat resistance, abrasion resistance, and the like. For example, an outermost shell or layer of the glove may be fabricated from a tough, abrasion-resistant and likely heat-resistant material that shields the hand from heat and permits any gripping or grasping that might be required by the wearer. Inside this outer layer, a moisture barrier layer may be provided to prevent the firefighter's hands and any intervening layers within the glove from being soaked with water or from being contaminated or damaged by potentially dangerous liquids, such as blood, solvents, or other chemical liquids. Alternatively or in addition to the moisture barrier layer, one or more additional layers may be provided inside the outer layer (and/or inside the moisture barrier layer, if provided). This layer may be formed from a soft yet heat-resistant material which may provide a degree of padding for the wearer's hand. Multiple-layer gloves are worn by a variety of users in other industries or for purposes other than firefighting where multiple layers may provide additional protection or utility for the wearer or the wearer's hands.

Traditionally, a lack of features with which to grip the glove for donning a glove onto a wearer's hand may lead to delay and frustration. There exists a need, therefore, to enable a wearer to quickly and easily don a glove, particularly in situations where the glove may be bulky in view of the extreme conditions in which they are worn.

SUMMARY

A glove is disclosed having a donning assister to enable a wearer of the glove to quickly and easily don a glove on a wearer's hand. In one embodiment, a glove comprises a wrist cuff portion, a hem portion positioned at a base of the wrist cuff portion, an at least partially enclosed space defined by the hem portion, and a gripper positioned in the at least partially enclosed space. The at least partially enclosed space is defined by hem stitches and by a pair of laterally opposed stitches positioned along a circumference of the hem portion.

The gripper may include a segment of plastic tubing. The gripper may include a cylinder. The gripper may include a metal. The gripper may include a sealant. The gripper may stick to interior surfaces of the at least partially enclosed space.

In another embodiment, a glove comprises (a) a wrist cuff portion, (b) a hem portion positioned at a base of the wrist cuff portion, the hem portion defining an at least partially enclosed space within the hem portion, the at least partially enclosed space defined by a fold of glove material stitched to create a finished edge at the base of the wrist cuff portion, and (c) a gripper positioned in the at least partially enclosed space of the hem portion on the palm side of the glove and along a circumference of the hem portion between a thumb of the glove on one end and a pinky finger of the glove on the other end.

The gripper may include a segment of plastic tubing. The gripper may include a cylinder. The gripper may include a metal. The gripper may include a sealant. The gripper may stick to interior surfaces of the at least partially enclosed space. The at least partially enclosed space may be further defined by at least one lateral stitch line positioned adjacent to an end of the gripper.

In another embodiment, a glove comprises a wrist cuff, a hem positioned at a base of the wrist cuff, the hem defining an at least partially enclosed space within the hem, the hem and the at least partially enclosed space defined by a fold of glove material stitched to create a finished edge at the base of the wrist cuff, and a plurality of grippers positioned in the at least partially enclosed space of the hem on the palm side of the glove and along a circumference of the hem between a thumb of the glove on one end and a pinky finger of the glove on the other end.

At least one gripper may include a segment of polyethylene tubing. At least one gripper may include a cylinder. At least one gripper may include a metal or a plastic. At least one gripper may include a sealant. The at least one gripper may stick to interior surfaces of the at least partially enclosed space. The at least partially enclosed space may be further defined by at least one lateral stitch line positioned adjacent to an end of at least one gripper.

DETAILED DESCRIPTION

Figure 1:
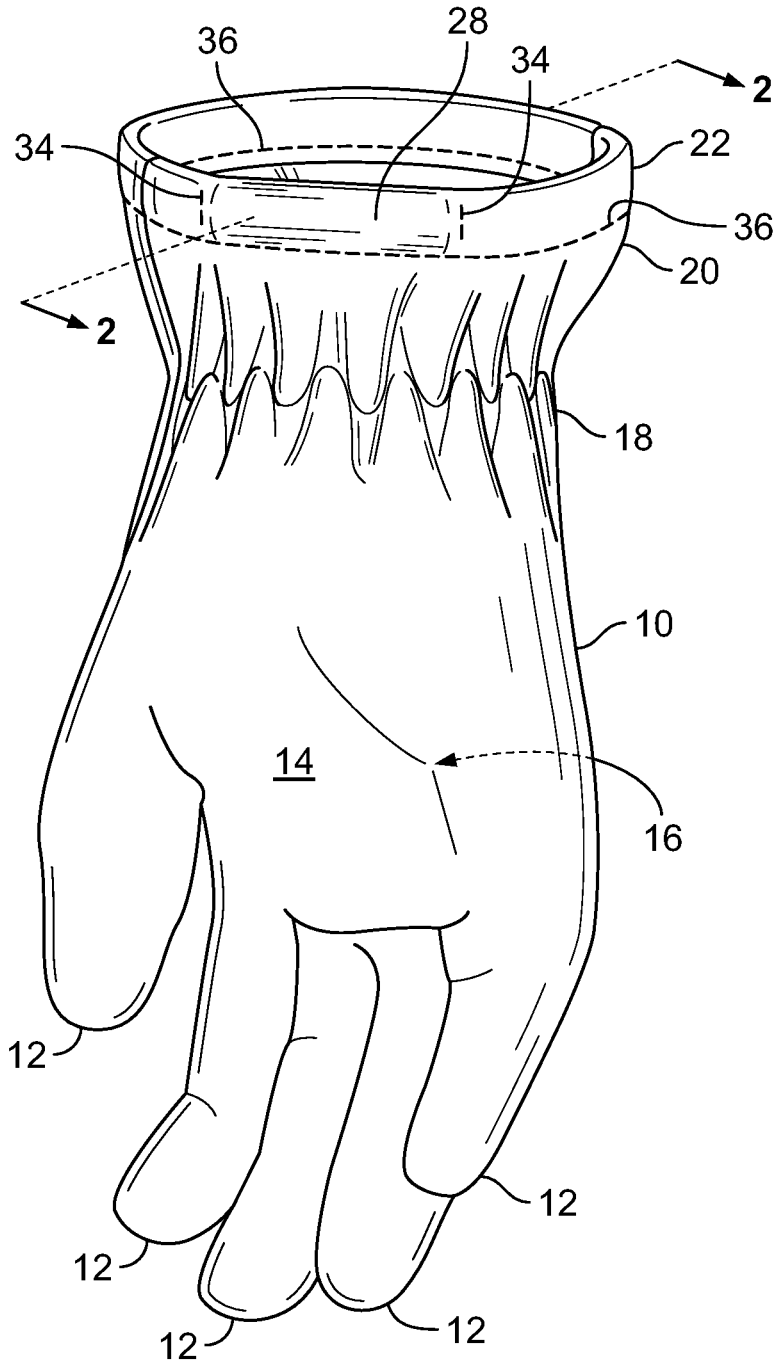
FIG. 1 is a perspective view showing an embodiment of a glove of the instant disclosure.

Although the figures and the instant disclosure describe one or more embodiments of a construction for a glove, one of ordinary skill in the art would appreciate that the teachings of the instant disclosure would not be limited to these embodiments. For example, the teachings of the instant disclosure may be applied to any article of clothing. It should be appreciated that any of the features of an embodiment discussed with reference to the figures herein may be combined with or substituted for features discussed in connection with other embodiments in this disclosure.

Turning now to the figures, wherein like reference numerals refer to like elements, there is shown one or more embodiments of a glove gripping system to enable a wearer to quickly and easily don a glove onto the wearer's hand.

Referring to FIG. 1, there is shown an exemplary glove 10 including donning assister 28. Glove 10 includes five finger portions 12 including the thumb, palm portion 14 (not shown), dorsal portion 16, and wrist portion 18. Wrist portion 18 may include a cuff portion 20, which may include a hem portion 22. In other embodiments, wrist portion 18 may include any of a number of different constructions known in the art. Likewise, in other embodiments, glove 10 may have other numbers of finger portions 12 or none at all like a mitten. It will be understood that reference to a "finger" or a "fingertip" relates to any or all of the digits of any layer of glove 10, and further includes the portion surrounding a wearer's fingers if glove 10 is configured as a mitt. Although glove 10 is illustrated as being a right hand glove, it would be appreciated that the instant disclosure is applicable to a left hand glove as well. Those of ordinary skill will appreciate that gloves made in accordance with the disclosure herein can extend for any length down the wearer's arm, from gloves that end at about the wrist of the wearer, to relatively long gauntlet-styles or other constructions which may integrate a portion of glove 10 with another garment.

Glove 10 may include any number of glove layers, such as an inner layer, a barrier layer, a thermal layer, an outer layer, or any combination of these. In one embodiment, the inner layer may be the innermost layer over which may lie a barrier layer. A thermal layer may lie over the barrier layer, and an outer layer may lie over the thermal layer to form glove 10. Glove 10 may include fewer or greater number of layers. For example, glove 10 may omit the barrier layer if, for example, the intended use does not call for protection from moisture or hazardous liquids or vapors or if one of the other layers of glove 10 inherently incorporates or otherwise includes protection from moisture or hazardous liquids. For simplicity, FIGS. 1 through 4 of the instant disclosure show only one glove layer, but the figures should be interpreted as representing one or more glove layers.

The outer layer may include any abrasion resistant material, such as leather, canvas, Kevlar®, and the like, and material blends or composites such as PBI/Kevlar® (i.e., polybenzimidazole synthetic fibers blended with poly para-phenylene terephthalamide synthetic fibers), or any other suitable material that offers the required protection or performance in extreme conditions. The outer layer may include multiple pieces stitched together. The outer layer may also include fabric that overlaps other portions of the outer layer or which covers other portions of the outer layer. In one embodiment, a piece of fabric may be stitched over an outer surface of one or more finger portions 12 to provide additional abrasion or wear resistance or protection to a wearer's fingers. In another embodiment, one or more finger portions 12 may comprise multiple sections of fabric stitched or otherwise joined together to form the one or more finger portions 12. For example, the top portion of an index finger portion of the outer layer may be stitched to a lower portion of the index finger portion to form a stitch line at or near a knuckle of the wearer to produce a hinge for ease of motion of glove 10 by the wearer. The outer layer may comprise any number of fabric weights, including a 3.5-3.75 oz leather.

The inner layer (not shown) may include a knitted, woven, or nonwoven material and may include wool, polyethylene or any numerous known or yet to be developed organic or inorganic fibers and fabrics. The inner layer may include a felt-like texture on its inside surfaces for wearer comfort and a relatively smooth texture on its outside surfaces to enhance adhesion thereto of the barrier layer, if present. The inner layer may have flame resistant or flame retardant properties and may resist heat transfer therethrough to act as a thermal lining on its own merits as a part of the overall thermal resistance of glove 10. Such properties may arise either as inherent properties of the fiber or material from which the inner layer is made, or due to one or more coatings or thermal laminations applied to the outer surface of the inner layer. In one embodiment, the inner layer comprises a self extinguishing brushed fleece (SEF) to provide a measure of flame and heat resistance as well as comfort to a wearer of glove 10. The inner layer may comprise any number of fabric weights, such as 4 oz, 8 oz, 10 oz and the like. Style F106 modacrylic fleece and style F550 Kevlar®, a material comprising poly para-phenylene-terephthalamide, from Draper Knitting Company are each suitable materials for the inner layer. Style F106 modacrylic fleece, for example, is a self extinguishing fabric with a brushed fleece surface on one side and a relatively smooth surface on the other. Style F106 modacrylic fleece is approximately 0.70 mm thick and is flexible and conformable to a wearer's hand.

A laminate such as a film or a coating may be applied or adhered to the outside surfaces of the inner layer to serve as a barrier to moisture, harmful liquids, and/or chemicals. In one embodiment, the barrier layer is laminated and/or adhered to the outer surfaces of the inner layer using a suitable adhesive. In another embodiment, the barrier layer comprises a shell that completely encases the inner layer and is connected to by, for example, stitches to the inner layer. The barrier layer comprises a material that is completely waterproof, such as a polyethylene, microporous polyether urethane or expanded polytetrafluoroethylene (PTFE) film, or may be formed from a breathable material that is impervious to liquid but permeable to water vapor such that perspiration from the hands may escape through the inner layer, through the barrier layer and ultimately through the outer layer to the outside of glove 10. In another embodiment, the barrier layer comprises a chemical treatment applied to a glove layer to cause the layer to resist penetration or transmission of water or vapor therethrough, but which may not truly render the glove layer waterproof or vaporproof. The barrier layer may comprise thermal protection properties. The barrier layer may also provide a barrier to blood or other biohazards, or one or more types of hazardous chemicals, such as caustic solutions, solvents, dyes, industrial wastes and the like. As would be appreciated by one of ordinary skill, certain barrier materials are more resistive to particular classes of hazardous chemicals than others. The choice of a barrier material may depend upon the anticipated types of hazards to which the wearer may be exposed. Thus, as used herein, the term "barrier layer" includes materials that are resistant to one or more types of hazardous liquids, chemicals, viruses, bacteria, and the like. Gore® RT7100 material, which is available from W. L. Gore & Associates, Inc., is a suitable material for the barrier layer. Gore® RT7100 material includes an adhesive on one side for adhering to the inner layer, for example, and a smooth surface on the other side for receiving the adhesive backed thermal layer. Gore® RT7100 material is approximately 0.02-0.08 mm (~1-3 mil) thick, is flexible, and conforms to the shape of the inner layer when adhered thereon. Other suitable materials for the barrier layer include Gore® Crosstech® film technology insert and Gore® Crosstech® insert.

The thermal layer may include an adhesive on one side for adhering to outer surfaces of the barrier layer. Alternatively, the thermal layer may be adhered to inner surfaces of the outer layer by the thermal layer adhesive. The thermal layer may alternatively be adhered to outer surfaces of the inner layer if a separate barrier layer is not present.

To form an inner portion comprising the inner layer, the barrier layer, and the thermal layer, the barrier layer may be affixed or otherwise laminated to the inner layer using an adhesive, and the thermal layer may be affixed or otherwise laminated to the barrier layer using an adhesive. The inverted outer layer may then be attached to the inner portion, then folded over the inner portion to form glove 10. Although a gap may be exist therebetween, inner surfaces of the outer layer and outer surfaces of the inner portion may be and likely are in contact with one another, depending on the dimensions and tolerances of the patterns associated with the outer layer and the inner portion. In other embodiments, the barrier layer may not affixed or otherwise laminated to the inner layer using an adhesive and instead may be connected to the inner layer by, for example, stitching the components together, then folding the barrier layer over the inner layer.

When clutching an object, a wearer's closed or partially closed hand tends to cause extension of the glove layers located on the top and/or along at least the bridge (i.e., dorsal) portion of the hand, which tends to flatten the layers as the layers bend around the wearer's knuckles, resulting in less thermal protection in these areas. To protect a wearer of glove 10 while maximizing dexterity and minimizing glove bulk, the thermal layer may be positioned to cover at least the knuckles of the wearer's fist, or larger areas such as the entirety of the bridge/dorsal side/back side of the wearer's hand. The thermal layer may extend down finger portions 12, for example, along at least the top surface of the wearer's fingers to provide additional protection in these areas without sacrificing a wearer's finger or hand dexterity. In some embodiments, the thermal layer comprises a shell that encases the barrier layer, if present, and the inner layer.

In one embodiment, to minimize bulk of glove 10 and particularly over the bridge/dorsal portion and knuckle portions so as to maintain flexibility and dexterity of the hands and fingers of a wearer of glove 10, the thermal layer comprises Gore® tape Model T-4999 without dry edge, which is available from W. L. Gore & Associates, Inc. In other embodiments, the thermal layer of glove 10 may include any material that provides the benefits described below.

Gore® tape Model T-4999 is approximately 0.30 mm (~0.01 inch) thick, flexible, and is a rip and/or tear resistant material that conforms to the surface to which it is adhered. Gore® tape Model T-4999 combines a durable Gore® laminate with a pressure sensitive adhesive for durable adhesion in relatively hot, cold and wet environments. Gloves and garments comprising Gore® tape Model T-4999 meet NFPA 1971 standards when Gore® tape Model T-4999 is used or incorporated in such gloves or garments as described herein. The adhesive properties of the thermal layer avoids requiring stitching to an adjacent layer. The adhesive properties of the thermal layer also avoids shifting of the thermal layer relative to adjacent layers during use by a wearer over time thereby offering continuous protection in all areas of glove 10 for the life of glove 10 without incurring any unprotected areas to the wearer over time. Surprisingly, use of the thermal layer comprising Gore® tape Model T-4999 or any functionally and proportionally similar material provides substantially improved thermal protection performance over the use of traditional fabrics and glove constructions—without the need to add additional layers or bulk to increase the thermal protection performance value of gloves—while maintaining or improving a wearer's finger dexterity by minimizing glove layer bulk as would otherwise occur. The thermal layer may provide these performance benefits without affecting the flexibility of the barrier layer.

Turning again to FIG. 1, there is shown donning assister 28 for assisting a wearer to don glove 10 onto the wearer's hand. In one embodiment, donning assister 28 is positioned within hem portion 22 along a circumference on the palm side of glove 10 defined by the thumb of the glove on one end and the pinky finger of the glove on the other end. In one embodiment, donning assister 28 is positioned within hem portion 22 along a circumference on the palm side of glove 10 and approximately in the middle between the thumb of the glove on one end and the pinky finger of the glove on the other end. In other embodiments, donning assister 28 may be positioned anywhere within hem portion 22 along the circumference of glove 10. In still other embodiments, donning assister 28 may be positioned on other portions and/or sides of glove 10. As described more fully below, donning assister 28 provides a wearer with a tactile, easy to locate, and easy to grab feature at or near the base of glove 10 to enable a wearer to quickly and easily don a glove onto one hand by gripping the donning assister 28 between the index finger and the thumb of the other hand.

Figure 2:
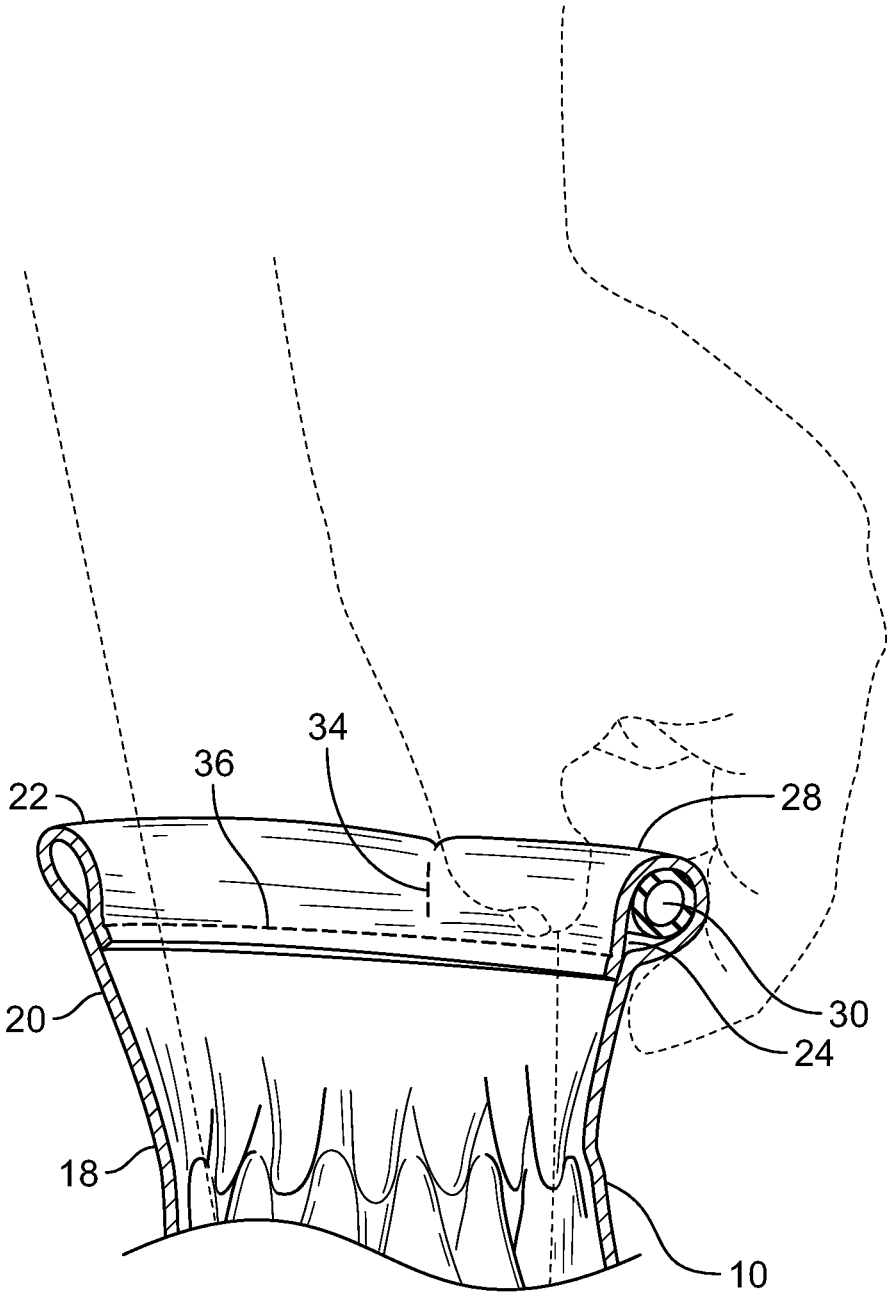
FIG. 2 is a partial detail view taken along lines 2-2 of the embodiment shown in FIG. 1 shown in use.
Figure 3:
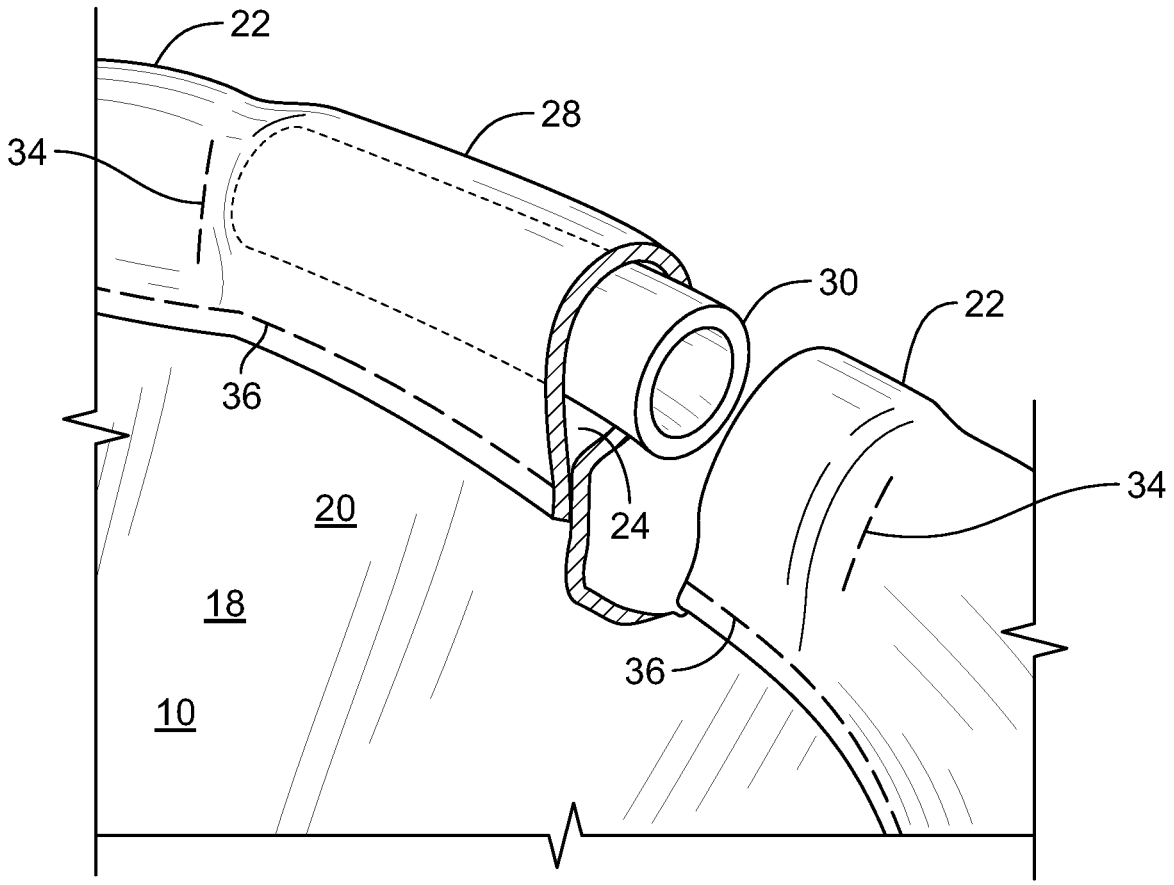
FIG. 3 is a partial detail perspective view of the embodiment of FIG. 1.
Figure 6:
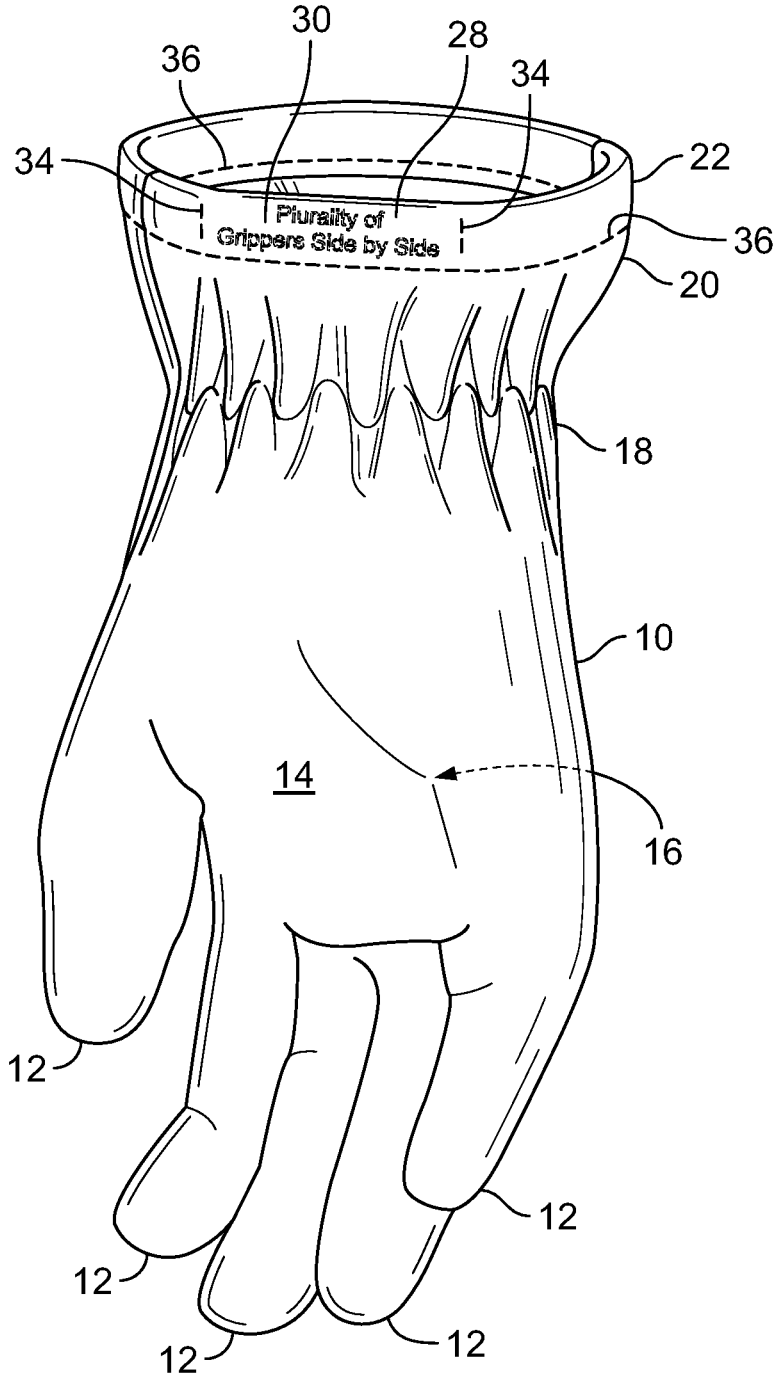
FIG. 6 is a perspective view showing an embodiment of a glove of the instant disclosure.

Turning to the embodiments of FIGS. 2, 3 and 6, donning assister 28 includes gripper 30 positioned along a circumference of cuff portion 20 and within hem portion 22. In other embodiments, a plurality of grippers 30 may be positioned along the circumference of cuff portion 20 and within hem portion 22. For example, multiple grippers 30 may be arranged in a repeating or a non-repeating sequence along the circumference of cuff portion 20 and within hem portion 22. In one embodiment, a pair of grippers 30 is arranged side by side along the circumference of cuff portion 20 and within hem portion 22.

Gripper 30 may include any number or type of rigid or semi-rigid articles and may be configured in any of a number of cross-sectional geometries, including circular, square, triangular, diamond, pentagon, hexagon, etc. For example, in some embodiments, gripper 30 is configured in the shape of a tube, a cylinder, a sphere, a box, or any combination of these.

In some embodiments, gripper 30 may be configured from a sewing cord fashioned into one or more segments. In other embodiments, gripper 30 may be configured from a coaxial cable fashioned into one or more segments. In still other embodiments, gripper 30 may be configured from a glass, a rubber, a plastic, a foam, a metal, a composite, a caulk, a hardened or semi-hardened liquid, a semi-solid material, or any combination of these or any material consistent with the purposes of the instant disclosure.

In the embodiment shown in FIGS. 2 and 3, gripper 30 includes round tubing approximately 1.875" long with a diameter of approximately 0.25". The tubing may comprise one or more of the materials described above, including polyethylene or other plastic, a foam, a metal, a rubber, etc. The round tubing may be configured as a rigid, a semi-rigid, or a resilient member, or any combination of these. The length and diameter of gripper 30 may vary from these dimensions depending on the size of the glove and the size of hem portion 22 so as to be large enough to aid in the donning of glove 10 while being small enough to avoid interfering with other garments worn by the wearer or other uses and purposes of glove 10. For example, in one embodiment, gripper 30 may be configured to be approximately 1.0" long. In other embodiments, gripper 30 may be approximately 0.5" long. In some embodiments, gripper 30 may range in diameter from approximately 0.1875" to approximately 0.5". In some embodiments, gripper 30 may be relatively light in weight. In other embodiments, gripper 30 may be relatively heavy to more easily identify its location by "feel" rather than by visual means.

As shown in FIGS. 2 and 3, donning assister 28 may include one or more lateral stitch lines or stitches 34 positioned adjacent opposite ends of gripper 30 to maintain the relative position and/or constrain the movement of gripper 30 within hem portion 22. As shown in the drawings, lateral stitches 34 are generally oriented perpendicular to hem stitch line or stitches 36, but may be positioned at any angle in other embodiments. Lateral stitches 34 together with hem stitches 36 of hem portion 22 and the glove material forming hem portion 22 are configured to form a hem pocket 24 (see, e.g., FIG. 2) defining an at least partially enclosed space along the bottom edge of cuff portion 20 to receive gripper 30 and to constrain the position of gripper 30 in all directions. In some embodiments, lateral stitches 34 need not extend from hem stitches 36 to the bottom of glove 10, as shown in FIGS. 1 through 3. However in other embodiments, as shown in FIG. 4, lateral stitches 34 may extend from hem stitches 36 to the bottom of glove 10.

In some embodiments, lateral stitches 34 are omitted altogether or are optional. Omission of lateral stitches 34 may reduce the cost of glove 10 by eliminating an unnecessary step in the manufacture of glove 10. For example, donning assister 28 may be configured to provide freedom of movement of gripper 30 along the circumference of hem portion 22 of cuff portion 20 in embodiments where freedom of movement of gripper 30 is desired. In some embodiments, lateral stitches 34 may be omitted if the characteristics of gripper 30 alone or in combination with the characteristics of glove 10 inhibit movement of gripper 30 within hem portion 22 when freedom of movement of gripper 30 is not desired. In some embodiments, lateral stitches 34 may be omitted if gripper 30 is configured to render lateral stitches 34 unnecessary. For example, in one embodiment, gripper 30 is formed in the shape of a ring, for example, to be inserted in the entirety of the circumference of hem portion 22 to be bounded solely by hem stitches 36 and the glove material forming hem portion 22. Gripper 30 formed in the shape of a ring may be configured to fill the most of the volume of hem portion 22 along the circumference of cuff portion 20 or any portion of the volume of hem portion 22.

Figure 4:
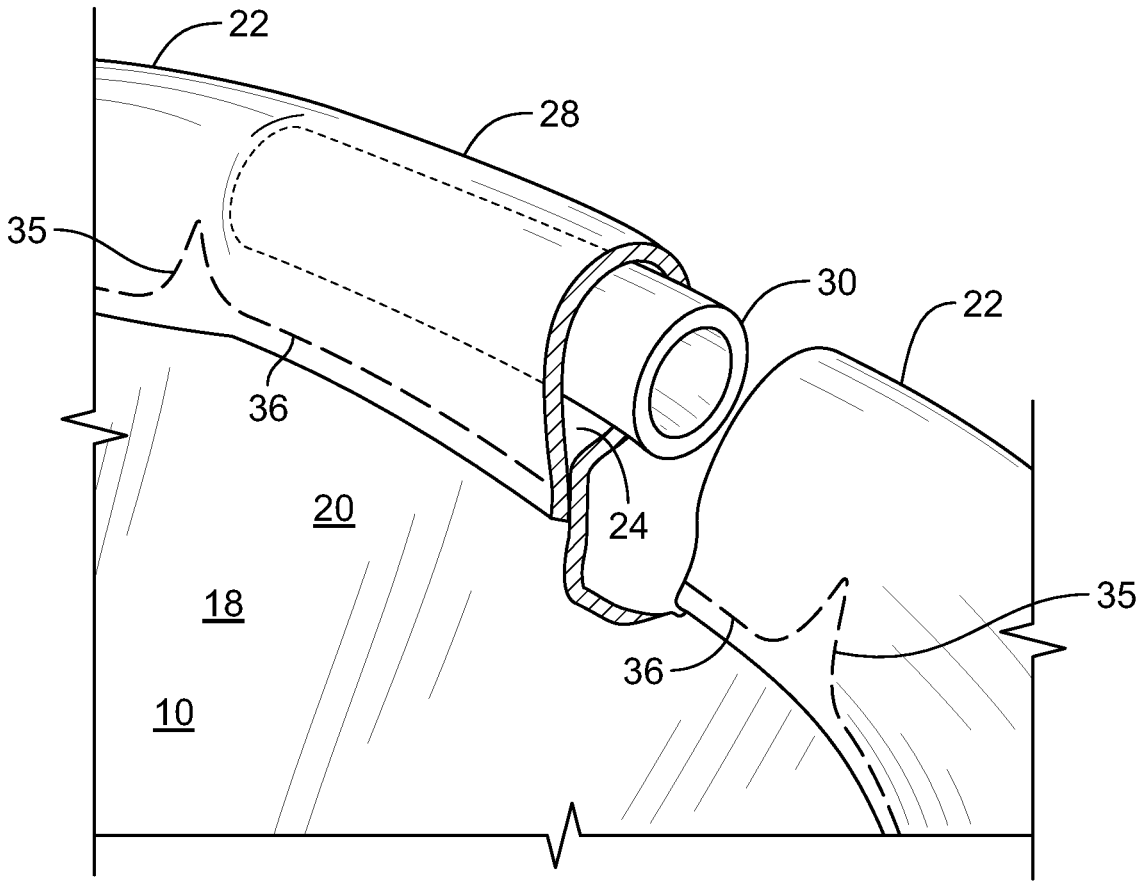
FIG. 4 is a partial detail perspective view of another embodiment of a donning assister of the instant disclosure.

FIG. 4 shows one embodiment in which lateral stitches 34 are omitted. In this embodiment, hem stitches 36 are configured to slightly deviate at one or both lateral ends of gripper 30 from being primarily parallel to the bottom edge of hem portion 22 of cuff portion 20 to create pinch stitches 35 that cause a narrowing or pinching of the cross section of hem portion 22 adjacent to one or both ends of gripper 30. Pinch stitches 35 of hem stitches 36 may deviate from or extend from the general line of hem stitches 36 to the extent as may be desired. Pinch stitches 35 may include any configuration, such as sloped, curved, purely vertical, or any combination thereof. This configuration eliminates the need for a second manufacturing step to insert lateral stitches 34 while providing a configuration in which gripper 30 is constrained from movement in hem portion 22.

Figure 5:
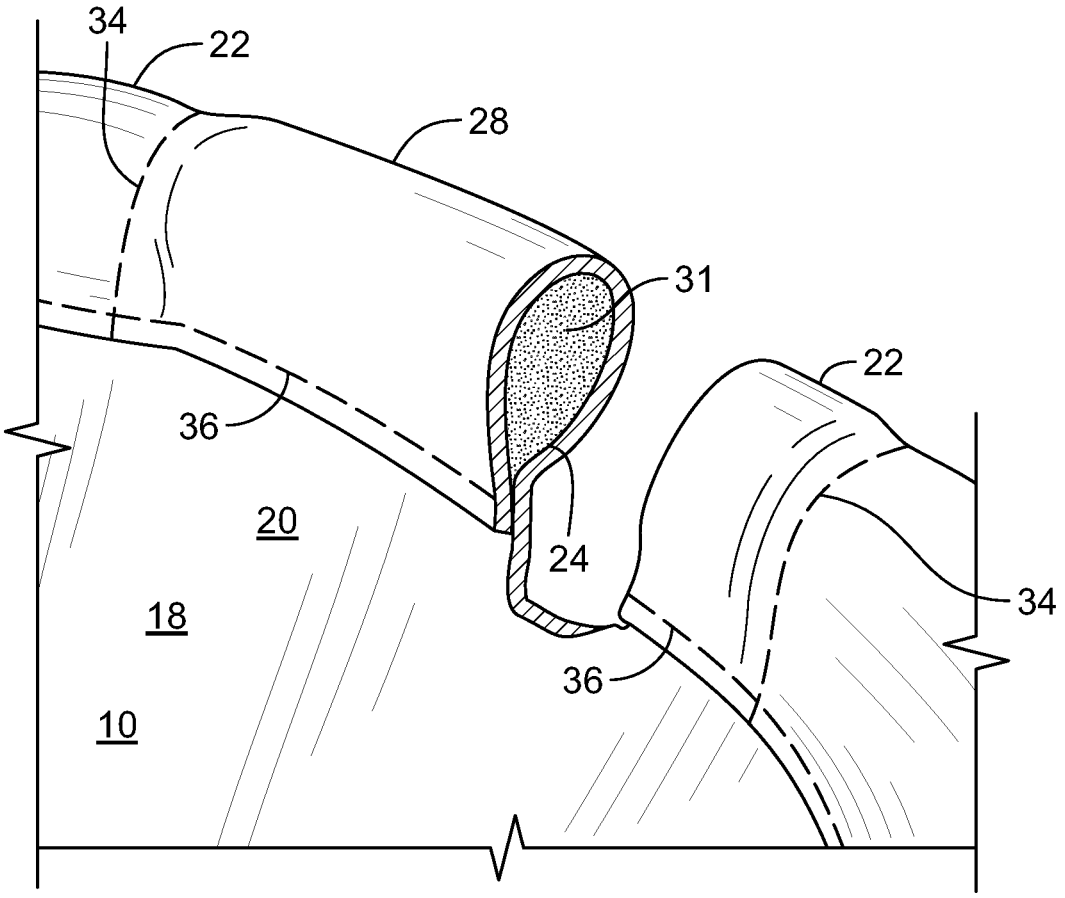
FIG. 5 is a partial detail perspective view of another embodiment of a donning assister of the instant disclosure.

Turning to the embodiment shown in FIG. 5, donning assister 28 may include gripper 31 comprising a caulk or a sealant, such as a silicone sealant or other material that is a liquid or semi-liquid at room temperature, positioned in hem pocket 24 formed by hem stitches 36, one or both lateral stitches 34, and the glove material forming hem portion 22. To insert gripper 31 into hem pocket 24, the sealant, for example, may be injected into hem pocket 24 and thereafter allowed to dry. In other embodiments, hem pocket 24 is temporarily formed in hem portion 22 by pinching respective lateral ends of hem portion 22 to define an at least partially enclosed space in hem portion 22. Thereafter, the sealant, for example, may be injected into the at least partially enclosed space formed inside hem portion 22 and the sealant is allowed to dry. One or both of lateral stitches 34 may optionally be omitted if one or both lateral ends are pinched prior to injection because gripper 31 formed from the sealant, for example, may have properties that cause the sealant to stick to the glove material forming the hem portion 22 to render gripper 31 immobile within hem portion 22 after drying.

Donning assister 28 comprising gripper 31 provides the added advantage of being able to retrofit existing or previously manufactured gloves having hem portions 22 to include gripper 31, depending on the size of the pre-existing hem portion 22 and the space therein. Gripper 31 comprising sealant, for example, may be injected as described above into an at least partially enclosed space in the hem portion 22 formed by pinching hem portion 22 in at least one location to form a barrier to the sealant in hem portion 22 or by inserting one or more lateral stitches 34 onto hem portion 22 to form a barrier to the injected sealant.

While specific embodiments have been described in detail, it will be appreciated by those skilled in the art that various modifications and alternatives to those details could be developed in light of the overall teachings of the disclosure. Accordingly, the disclosure herein is meant to be illustrative only and not limiting as to its scope and should be given the full breadth of the appended claims and any equivalents thereof.

What is claimed is:

1. A glove comprising a palm side and a back side; wherein said palm side is configured to cover to the palm and back sides of wearer's hand when worn; the glove comprising:

a wrist cuff portion; a hem portion positioned at a base of the wrist cuff portion; an at least partially enclosed space defined by the hem portion, the at least partially enclosed space defined by hem stitches and by a pair of laterally opposed stitches positioned along a circumference of the hem portion; and a semi-rigid or rigid gripper positioned in the at least partially enclosed space; and wherein the gripper comprises a first end and a second end opposite the first end, and the first and second ends lie on the palm side of the glove within the at least partially enclosed space of the hem portion; wherein the pair of laterally opposed stitches includes a first lateral stitch positioned adjacent to the first end of the gripper and a second lateral stitch positioned adjacent to the second end of the gripper to constrain circumferential movement of the gripper in the hem portion, and the first and second lateral stitches lie on the palm side of the glove.

2. The glove of claim 1, wherein the gripper includes a segment of plastic tubing.

3. The glove of claim 1, wherein the gripper includes a cylinder.

4. The glove of claim 3, wherein the gripper includes a metal.

5. The glove of claim 1, wherein the gripper includes a sealant.

6. The glove of claim 5, wherein the sealant is a caulk.

7. The glove of claim 1, wherein the gripper sticks to interior surfaces of the at least partially enclosed space.

8. A glove comprising a palm side and a back side; wherein said palm side is configured to cover to the palm and back sides of wearer's hand when worn; the glove comprising:

a wrist cuff portion; a hem portion positioned at a base of the wrist cuff portion, the hem portion defining an at least partially enclosed space within the hem portion, the at least partially enclosed space defined by a fold of glove material stitched to create a finished edge at the base of the wrist cuff portion; and a gripper positioned in the at least partially enclosed space of the hem portion, the gripper located solely on the palm side of the glove and along a circumference of the hem portion between a thumb of the glove on one end and a pinky finger of the glove on the other end; wherein the gripper includes a cylinder.

9. The glove of claim 8, wherein the gripper includes a segment of plastic tubing.

10. The glove of claim 8, wherein the gripper includes a metal.

11. The glove of claim 8, wherein the gripper includes a sealant.

12. The glove of claim 8, wherein the gripper sticks to interior surfaces of the at least partially enclosed space.

13. The glove of claim 8, wherein the at least partially enclosed space is further defined by at least one lateral stitch line positioned adjacent to an end of the gripper.

14. A glove comprising a palm side and a back side; wherein said palm side is configured to cover to the palm and back sides of wearer's hand when worn; the glove comprising:

a wrist cuff; a hem positioned at a base of the wrist cuff, the hem defining an at least partially enclosed space within the hem, the hem and the at least partially enclosed space defined by a fold of glove material stitched to create a finished edge at the base of the wrist cuff; and a plurality of rigid grippers positioned side by side and unattached to one another in the at least partially enclosed space of the hem on the palm side of the glove and along a circumference of the hem between a thumb of the glove on one end and a pinky finger of the glove on the other end; wherein the at least one gripper sticks to interior surfaces of the at least partially enclosed space.

15. The glove of claim 14, wherein each of the grippers includes a segment of polyethylene tubing.

16. The glove of claim 15, wherein at least one gripper includes a cylinder.

17. The glove of claim 16, wherein at least one gripper includes a metal or a plastic.

18. The glove of claim 15, wherein the at least partially enclosed space is further defined by at least one lateral stitch line positioned adjacent to an end of at least one gripper.

19. The glove of claim 15, wherein all of the grippers lie on the palm side of the glove.

* * * * *